United States Patent [19]

Biolik et al.

[11] 4,158,743

[45] Jun. 19, 1979

[54] ELECTRIC RESISTANCE FURNACE

[75] Inventors: Felicjan Biolik, Myslowice; Franciszek Gurgul, Katowice; Stanislaw Odrobina, Katowice; Zygmunt Morys, Katowice; Alfons Wieczorek, Myslowice; Zenon Wydmanski, Sosnowiec; Piotr Gawlowski, Katowice, all of Poland

[73] Assignee: Biuro Projektow Pyrzemyslu Metali Niezelaznych "Bipromet", Katowice, Poland

[21] Appl. No.: 768,884

[22] Filed: Feb. 15, 1977

[30] Foreign Application Priority Data

Mar. 1, 1976 [PL] Poland ..... 187637
Apr. 4, 1976 [PL] Poland ..... 188490

[51] Int. Cl.[2] ..... H05B 3/03
[52] U.S. Cl. ..... 13/25
[58] Field of Search ..... 13/18, 20, 25, 23, 6; 219/316

[56] References Cited

U.S. PATENT DOCUMENTS

| | | | |
|---|---|---|---|
| 3,293,412 | 12/1966 | Profitt et al. | 13/25 X |
| 3,688,007 | 8/1972 | McKenna et al. | 13/25 X |
| 4,039,737 | 8/1977 | Kemper | 13/18 |

*Primary Examiner*—R. N. Envall, Jr.
*Attorney, Agent, or Firm*—Haseltine, Lake & Waters

[57] ABSTRACT

An electric resistance furnace used for melting metals and maintaining them in melted condition. The furnace is also used for production of metal alloys, particularly for production of non-ferrous metals with direct heating of baths by means of resistance heating elements. The furnace has a chamber accommodating at least one heating element having the shape of a vessel provided with a current supply in the form of an electrode, preferably of graphite. The melted material is in contact with the walls and bottom of the heating element. The latter is dipped in the metallic bath placed in the chamber of the furnace, and the electrode is located partly inside the vessel.

5 Claims, 4 Drawing Figures

ELECTRIC RESISTANCE FURNACE

BACKGROUND OF THE INVENTION

The subject of the invention is an electric resistance furnace for melting metals, for maintaining them in a melted condition, and for production of metal alloys applicable particular to non-ferrous metals. The furnace operates with direct heating of bath by means of resistance heating elements.

Electric resistance furnaces known have, heretofore as a rule, heating elements located in the vault, walls and in the bottom of the furnace chamber or, as said in the Polish Patent No. 81,320, they are provided with heating elements shaped as one or several partitions located preferably parallel to the electrodes situated either directly in the bottom, or in the bottom in the vicinity of the ceramic walls of the melting bath. The partitions are built preferably of a uniform plate of ceramic material. These partitions are mounted in the bottom of the melting bath but their upper part reaches above or below the level of the metal being melted so that the whole surface of the partition or partitions be in contact with the melted metal or with the metallic bath.

The present Patent includes also a description of a resistance furnace in which the heating elements are in contact with the electrodes in the bottom or in the walls of the melting tank of the furnace, but so that at least one surface of the heating element is in contact with the melted metal or with a metallic bath, or, most favorably, built so that the bottom of the melting tank has the shape of the plate covering the botttom under which electrodes are accommodated.

The drawback of furnaces with heating elements built into the vault or in the side walls is their violent oxidation of charge. This is particularly the case if metals such as eg. zinc or aluminium are being melted by an intensive heating of the surface of the bath due to radiation of these heating elements. Melting losses encountered as a result of oxidation of the bath make it difficult to heat these baths because the layer of dross, has poor thermal conductivity. On the other hand, heating from below causes, in effect accelerated wear of the bottom plate, leading to leaking of the melted metal into the ducts of the heating tubes.

The design acc. to the Polish Patent No. 81,320 renders possible the melting of metals, particularly non-ferrous ones, with a good coefficient of utilization of electric energy and a simultaneous prolongation of the service life of the melting tank. On the other hand, the replacement or repair of the heating element is combined with serious difficulties exerting a negative influence on the quantity, frequency, and shutdown time, thus limiting the capacity of the furnace. The repairs are particularly troublesome and may even be dangerous for the repair workmen in view of the large size of the heating element, the high temperature of the furnace, and the presence of harmful gases.

SUMMARY OF THE INVENTION

The substance of the invention consists in the proper location of at least one heating element in the shape of a vessel accommodating a current supply means in the chamber of the electric resistance furnace with direct heating by means of heating elements in the shape of a partition. The molten metal is in contact with the bottom and walls of the heating element.

The heating element is immersed in the metallic bath situated in the chamber of the furnace and the electrode located therein is dipped in the metal, partly filling the interior of the furnace.

The heating element may be a crucible filled with the metal charge in which the electrode is dipped, while between the walls of the furnace and the bottom of the furnace chamber and the heating element there is a layer of metal.

The heating element is preferably made of a nitrided silicon carbide. The advantage of the invention is the considerable capacity of the furnace due to the possibility of the best possible arrangement of the heating elements in the chamber of the furnace, and the shortening of the duration of shutdown time necessitated by repair. The execution of all repair work is easy, simple and completely safe. Another advantage of the furnace according to the invention is its simple design, visible particularly in the case of furnaces of small capacity. An advantage, also, is the possible connection of furnaces in series to the main supply, and additional melting-in of the alloy components by the suitable selection of supply electrodes located inside the crucible.

The object of the invention is presented in exemplary embodiments in the enclosed figures.

DESCRIPTION OF THE PREFERRED EMBODIMENTS

Figure 1:
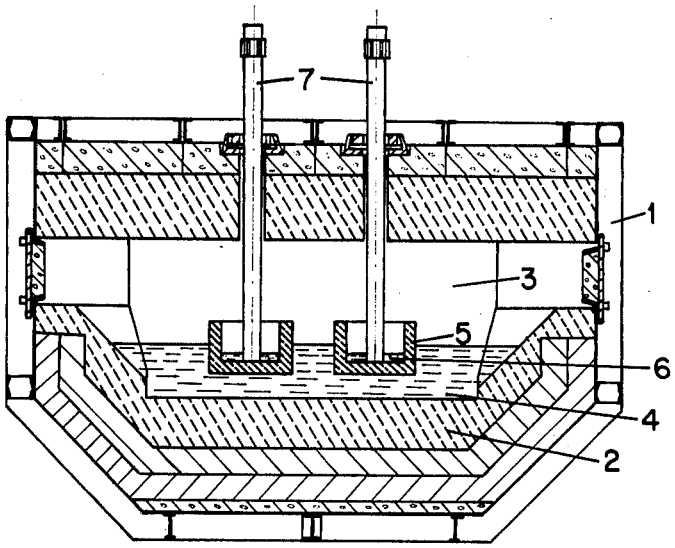
FIG. 1 presents the longitudinal section of the furnace.

The furnace consists of ceramic walls 1, which together with the bottom 2 form chamber 3 of the furnace or the melting tank. The melting tank 3 is partly filled with metal 4 to be melted. On the surface of metal 4 there are two heating elements 5 having the shape of a vessel filled in part with metal 6, which serves as an electric contact between the electrodes 7 dipped in the metal and the walls of heating elements 5. The heating elements 5 are made of nitrided silicon carbide whereas the electrodes are made of graphite or metal. Electric circuitry consists in sequence as follows: electrode 7, metal 6, wall of heating element 5, metal 4, wall of the next heating element 5, together with metal 6 and electrode 7 located therein. The furnace according to the example described above operates in the following way. Upon filling the melting tank 3 with a layer of metal 4, heating elements 5 are being put on its surface filled partly with metal 6 which serves to secure proper contact between the electrode 7 and the internal surface of the the walls of heating element 5. To the ends of electrodes 7 protruding beyond the furnace, voltage is supplied which causes in effect flow of the electric current and heat emission, raising the temperature of the metal and leading in effect to melting of the metal. The flow of electric current is as follows:

From electrode 7 dipped in metal 6 filling the bottom of one of heating elements 5 serving the purpose of securing proper electric contact, electric current flows through the wall of heating element 5 to metal 4, in which it is dipped. From metal 4, electric current flows through the wall of the subsequent heating element 5 and from there it flows away through metal 4 and electrode 7 located in this heating element to the terminale situated outside the furnace chamber. On finishing the melting process, the furnace is partly emptied either by tilting the furnace or by pumping out the metal bath 4 or finally by opening the drain hole situated in the bottom.

Figure 2:
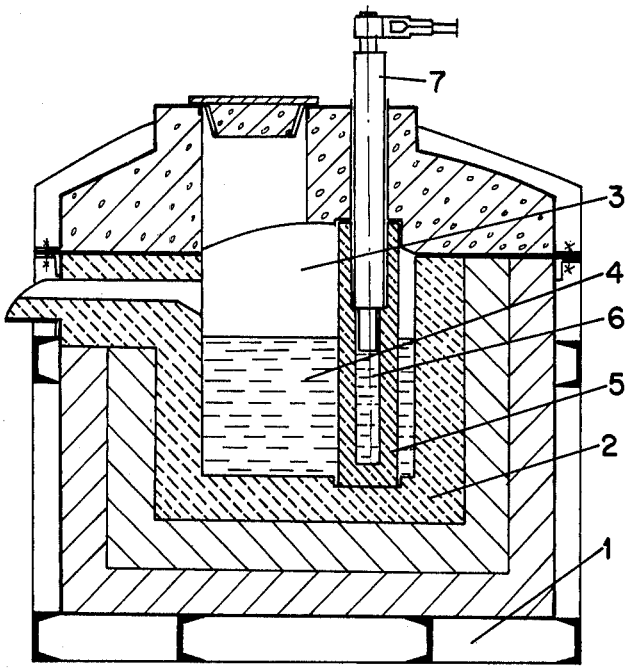
FIG. 2 —the cross-section of the furnace.
Figure 3:
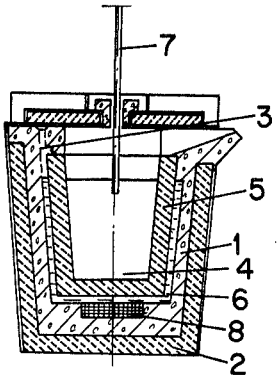
FIG. 3—a furnace with one crucible in the vertical section.

Another exemplary embodiment of the furnace according to the invention is presented in FIG. 2 in the cross section. It consists of ceramic walls 1, which together with bottom 2 forms the melting tank 3 of the furnace designed for melting metal 4. Inside this tank there are two heating elements 5 in the shape of a tube blanked on one end and made of nitrided silicon carbide, which are dipped in the metal 4. Inside the heating element 5 there is metal 6 forming electric contact for electrode 7, one end of which reaches the inside of the heating element 5 while the other is fixed above the cover of the furnace. Still another embodiment of the furnace according to the invention is presented in FIG. 3. It consists of ceramic walls 1, which together with the bottom 2 forms the ceramic chamber 3 of the furnace. Inside this chamber over the layer of metal 6 there is mounted the heating element 5 in the shape of a vessel serving simultaneously as a crucible for metal 4 located therein to be used as melting charge. The layer of metal 6 serves for improvement of the electric contaact between the walls 1 and bottom 2 of the furnace chamber 3 and the crucible heating element 5. Crucible heating elements 5 are made of nitrided silicon carbides and electrodes 7 of graphite or metal depending upon the metallurigical process realized in the furnace. In the bottom 2 of this chamber there is a graphite fitting 8 mounted in such a way that its one end is connected with the structure of the furnace and the other is covered with a layer of metal 6, thus ensuring the furnace current supply. The electric circuit of the furnace consist of electrode 7, metal 4 of the charge, walls and bottom of the crucible heating element 5, a layer of metal 6 and graphite fitting 8.

The furnace according to the above mentioned example of the embodiment of the invention operates in the following way:

Metal 4 of the charge in a solid state is charged to the crucible heating element 5. The emitted heating power in the walls and bottom of the element 5 causes, in effect, a rise of temperature and thereby leads to the heat flow to metal 4 of the charge and to the wall 1 and bottom 2 of chamber 3. The emitted heat causes melting of metal 4. In case of melting pure metal the electrode 7 is made of the material or graphite, and in case of the production of alloys, electrodes made of a metal being one of the components of the alloy are used.

Figure 4:
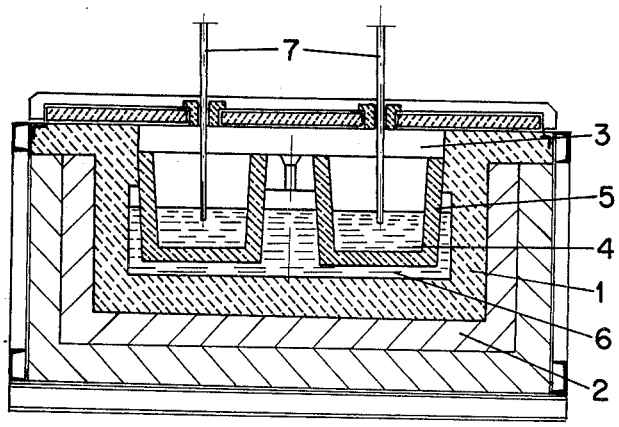
FIG. 4—a furnance with two crucibles in longitudinal vertical section.

In FIG. 4 is presented an example of embodiment of the furnace according to the invention with two crucible heating elements 5 located in chamber 3. The electric circuit of this furnace consists of elements as follows (in the given order): electrode 7, metal 4 of the charge wall and bottom of one element 5, layer of metal 6, walls and bottom of the second element 5, metal 4 filling the element and electrode 7 dipped therein.

The leading and heating process is similar to that described for a furnace with one crucible with the sole exception that it is being realized in two crucible shaped heating elements 5 working in series.

We claim:

1. An electric resistance furnace for melting metals and maintaining said metals in the melted condition and for producing alloys, particularly nonferrous metals, by direct heating of the furnace bath by resistance heating elements; wherein said furnace includes: a chamber in said furnace; at least one furnace heating element having the shape of a vessel in said chamber; said vessel having wall portions and a bottom, and current suply means having an electrode preferably of graphite, said electrode being dipped in a contact metal in said at least one heating element to complete an electric circuit to said heating element, the melted metal being in contact with the walls and bottom of said heating element and heat being transmitted directly to said metallic bath free of heat exchanging means.

2. An electric resistance furnace according to claim 1, wherein: said heating element is dipped in a bath of heated metal placed in said chamber of said furnace, said electrode being located in said heated metal fill partly to the inside of the vessel forming said heating element.

3. An electric resistance furnace according to claim 1, wherein: said heating element is in the form of a crucible filled with charge metal, said electrode being dipped in said charge metal, and a layer of metal between the walls and bottom of said furnace chamber and said heating element forming contact metal.

4. An electric resistance furnace according to claim 1, wherein: said heating element is made preferably of nitrided silicon carbide.

5. An electric resistance furnace according to claim 1, wherein: said heating element is dipped in a metallic bath placed in said chamber of said furnace, said electrode being located in said heated metal, partly filling the inside of the vessel forming the heating element having substantially the form of a crucible filled with charge metal, said electrode being dipped in said charge metal, and said metallic bath forming a layer of metal between the walls and bottom of said chamber and said heating element comprising nitrided silicon carbide, a potential difference being applied to said electrode and said layer of metal.

* * * * *